US008376354B2

(12) United States Patent
Pichon

(10) Patent No.: US 8,376,354 B2
(45) Date of Patent: Feb. 19, 2013

(54) APPARATUS FOR FEEDING SHEETLIKE ITEMS

(75) Inventor: Nicolas Pichon, Bagneux (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/354,027

(22) Filed: Jan. 19, 2012

(65) Prior Publication Data

US 2012/0187621 A1 Jul. 26, 2012

(30) Foreign Application Priority Data

Jan. 20, 2011 (EP) ..... 11151574

(51) Int. Cl.
*B65H 1/00* (2006.01)

(52) U.S. Cl. ..... 271/162; 271/171

(58) Field of Classification Search ..... 271/127, 271/162, 171

See application file for complete search history.

(56) References Cited

U.S. PATENT DOCUMENTS

2008/0084021 A1 4/2008 Nakamura
2010/0123283 A1 5/2010 Hayakawa

FOREIGN PATENT DOCUMENTS

| | | | |
|---|---|---|---|
| EP | 1 707 515 | A1 | 10/2006 |
| EP | 1719723 | A2 | 11/2006 |
| JP | 09-110193 | A | 4/1997 |
| WO | WO 2007/109642 | A2 | 9/2007 |

OTHER PUBLICATIONS

European Search Report, Application No. 11151574.8-1256; Jul. 15, 2011.

*Primary Examiner* — Michael McCullough
(74) *Attorney, Agent, or Firm* — Sughrue Mion, PLLC

(57) ABSTRACT

An apparatus for feeding sheetlike items from a stack has an item feed for separating and feeding a single item from the stack. A holder receives the stack and has a platform for supporting the stack, and a first and a second side guide for guiding items in a feeding direction. The platform is movable into a feeding position in which separating and feeding of a single item is enabled and into a loading position in which the holder is able to receive a stack. A side guide adjustment mechanism is provided for moving at least one side guide toward and away from the other side guide. A drive device is operably connected to the side guide adjustment mechanism. The drive device is out of engagement with the side guide adjustment mechanism when the platform is in the feeding position.

11 Claims, 3 Drawing Sheets

APPARATUS FOR FEEDING SHEETLIKE ITEMS

BACKGROUND OF THE INVENTION

The invention relates to an apparatus for feeding sheetlike items from a stack of sheetlike items. Such an apparatus is used in paper handling systems, such as inserters, printers and copier systems, and comprises an item feed means for separating and feeding a single item from the stack of sheetlike items.

Such an apparatus is known from EP-A2-1 719 723. This apparatus comprises a movable item platform for supporting a stack of sheetlike items, which is movable towards item feed rollers in order to initiate feeding. Movable side guides are provided to press against the edges of the stack to align the items if needed.

SUMMARY OF THE INVENTION

It is an object of the invention to improve the accuracy of side guide adjustment in an apparatus for feeding sheetlike items in order to improve the reliability of feeding sheetlike items.

It is a further object of the invention to simplify side guide adjustment or loading of sheetlike items in an apparatus for feeding sheetlike items.

To the end of obtaining at least one of these objects the invention provides an apparatus for feeding sheetlike items from a stack of sheetlike items, comprising: an item feed means for separating and feeding a single item from the stack of sheetlike items; a holder for receiving the stack of sheetlike items, said holder comprising an item platform for supporting the stack of sheetlike items, and a first and a second item side guide for guiding sheetlike items of the stack in a feeding direction, said item platform being movable towards the item feed means into a feeding position in which separating and feeding of a single item from the stack of sheetlike items by the item feed means is enabled and away from said item feed means into a loading position in which the holder is able to receive a stack of sheetlike items, at least one of said item side guides being movable relative to the other one; a side guide adjustment mechanism connected to said at least one item side guide such that when said side guide adjustment mechanism is moved in a first direction said at least one item side guide will move toward the other item side guide and when said side guide adjustment mechanism is moved in a second direction said at least one item side guide will move away from the other item side guide; a drive means connected to said side guide adjustment mechanism operable to cause said side guide adjustment mechanism to move in said first and said second direction; wherein said drive means is out of engagement with said side guide adjustment mechanism when said item platform is in the feeding position. What is achieved in that said drive means is out of engagement with said side guide adjustment mechanism when said item platform is in the feeding position, is that the side guide adjustment mechanism cannot be operated upon, as a result of which unintended adjustment of the item side guides is prevented, thereby increasing the accuracy of the side guide adjustment and the reliability of feeding the sheetlike items.

Loading of an apparatus for feeding sheetlike items and side guide adjustment in an apparatus for feeding sheetlike items is simplified in an embodiment of an apparatus according to the invention in which said drive means only is in engagement with said side guide adjustment mechanism when said item platform is in the loading position. In addition when adjusting the item side guides so that they are close to or in contact with the stack of sheetlike items, the sheetlike items in the stack are not in contact with the feeding means, e.g. a feeding roll, so that the feeding means do not hamper the adjustment of the item side guides.

The invention is in particular advantageous in an embodiment in which the first and the second item side guide are movable, and the side guide adjustment mechanism is connected to said first and said second side guides such that when said side guide adjustment mechanism is moved in a first direction said first and second item side guides will move towards each other and when said side guide adjustment mechanism is moved in a second direction said first and said second item side guides will move away from each other. A very accurate and simple adjustment of the side guides is then obtained by including a lead screw having a first portion with right hand threads operatively connected with said first item side guide and said second portion with left hand threads operatively connected with said second item side guide.

In an embodiment of an apparatus according to the invention in which the drive means includes an operator movable wheel member that is rotatable in a first direction and in a second direction and when rotated in said first direction said first and second item side guides will move towards each other and when rotated in said second direction said first and said second item side guides will move away from each other, said wheel member having an outer surface for engagement by the operator and in inner surface which is in engagement with the lead screw when said item platform is in the loading position, and which is out of engagement with the lead screw when said item platform is in the feeding position, a very failsafe operation of the apparatus is obtained. In a further improvement of this embodiment in which the item platform for supporting the stack of sheetlike items is mounted on a swivel axle positioned upstream of the feeding means in the feeding direction for swiveling movement towards the item feed means into the feeding position and away from said item feed means into the loading position, said lead screw and said wheel member being positioned in feeding direction between the swivel axle and the item feed means, the drive means can be placed out of engagement with said side guide adjustment by simply swiveling the platform to its feeding position. Vice versa, the drive means can be placed in engagement with said side guide adjustment by simply swiveling the platform into its loading position.

In a further embodiment of the apparatus according to the invention the apparatus comprises an outer housing, said outer housing comprising housing side walls adjacent to the holder, said operator movable wheel member being arranged in one of the housing side walls, said one housing side wall having a slot for tightly receiving the wheel member. In this embodiment the drive means, or in other words the operating means, operable to cause the item side guides to move toward and away from each other can without any objection be arranged in a fixed position on the housing, as a result of which it can better and easier be operated upon. In addition since the slot tightly receives the wheel member hardly any dust or other particles can enter the housing through the slot. This construction also prevents that adjustment of the wheel causes swiveling of the feeding platform.

In the feeding position the drive means is out of engagement with said side guide adjustment mechanism so that operator adjustment of the side guides by using the drive means is prevented. In addition any other unwanted adjustment, e.g. by engaging the item side guides themselves, is prevented when the apparatus comprises a lock for locking the at least one item side guide against relative adjustment when the item platform is in the feeding position. Preferably the lock is formed by a self-locking side guide adjustment mechanism. This can be for instance the case when applying a thread screw as described.

The described principle can be applied regardless of the orientation of the feeding mechanism with respect to the stack of sheetlike items. The described principle can for instance be applied to a top feeder as well as a bottom feeder.

Further objects, aspects, effects and details of the invention are described in the following detailed description of a number of exemplary embodiments, with reference to the drawings.

BRIEF DESCRIPTION OF THE DRAWINGS

FIG. 3 is a perspective view from below of the holder of the inventive apparatus, and.

DETAILED DESCRIPTION

Figure 1:
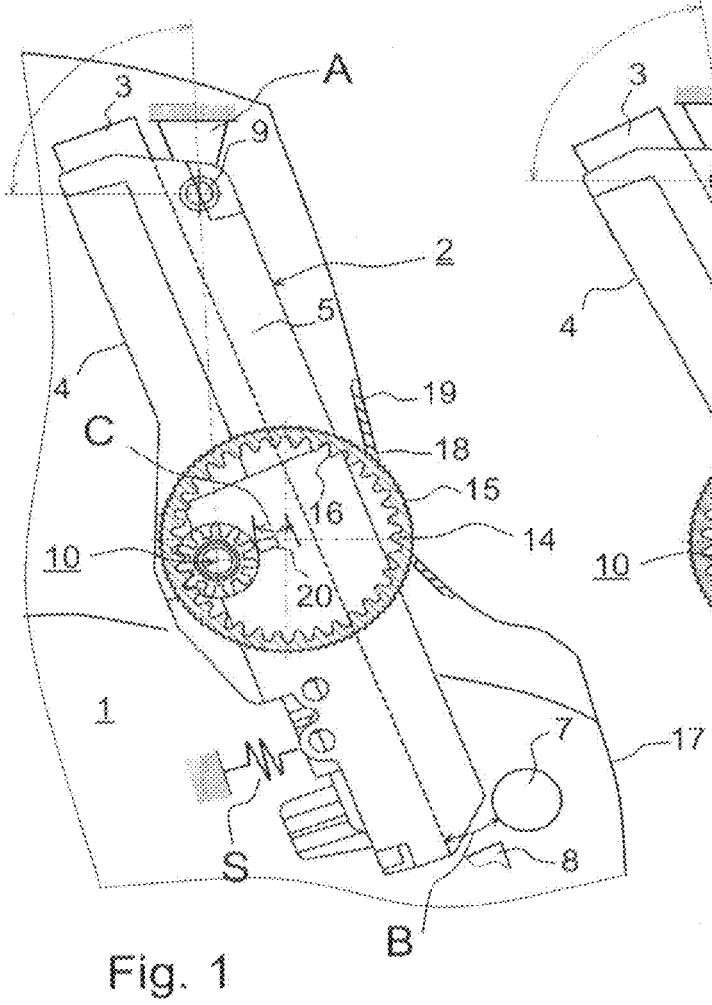
FIG. 1 is a schematic side view, partly in cross-section, of an apparatus according to the invention for feeding sheetlike items in which the holder is in the loading position.

The apparatus 1 (partly depicted in FIG. 1) for feeding sheetlike items has a paper holder 2 for receiving a stack 3 of sheetlike items. The holder 2 has an item platform 4 for supporting the stack 3 of sheetlike items (which sheetlike items are not separately depicted in FIGS. 1 and 2). In this context, sheetlike material is understood to mean inter alia: paper sheets, sets of paper sheets, booklets, credit cards, envelopes and other information carriers which are substantially flat and lend themselves to forming a stack. According to the example shown in FIGS. 1-3 the dimensions of the item platform 4 are such that it can receive a stack 3 of paper sheets at least in the range of A6 to A4 size.

On the longitudinal sides, the item platform 4 has a first item side guide 5 and a second item side guide 6 for guiding the sheetlike items of the stack 3 in a feeding direction F indicated by the arrow.

The apparatus 1 further comprises an item feed means 7, 8 for separating and feeding a single item from the stack 3 of sheetlike items. In the example shown in FIGS. 1-3 the item feed means comprises a (driven or drivable) feed roller 7 and a stop 8. However, the present invention is not limited to a specific type of item feed means for separating and feeding a single item and all known types of item feed means can be used in the inventive apparatus. An example of such a known item feed means is described in EP-A-0514441.

The item platform 4 for supporting the stack 3 of sheetlike items is mounted on a swivel axle 9 positioned upstream of the feeding means 7, 8 in the feeding direction for swiveling movement away from and towards the item feed means in particular towards the feed roller 7, into the feeding position (shown in FIG. 2) and away from the item feed means 7, 8 into the loading position (shown in FIG. 1). Thus the item platform 4 is movable towards the item feed means 7, 8 into the feeding position in which separating and feeding of a single item from the stack 3 of sheetlike items by the item feed means is enabled and away from the item feed means 7, 8 into the loading position in which the holder 2 is able to receive e.g. a new stack 3 of sheetlike items.

In order to be able to hold sheetlike items of different dimensions at least one of the item side guides 5, 6 is movable relative to the other one. In the example shown the first item side guide 5 and the second item side guide 6 are both movable (see FIG. 3). In order to effect this movement the apparatus 1 comprises a side guide adjustment mechanism 10 which is connected to the first and the second item side guides 5, 6 such that when the side guide adjustment mechanism 10 is moved in a first direction the first and second item side guides 5, 6 will move toward each other and when the side guide adjustment mechanism 10 is moved in a second direction the first and the second item side guides 5, 6 will move away from each other.

Figure 3:
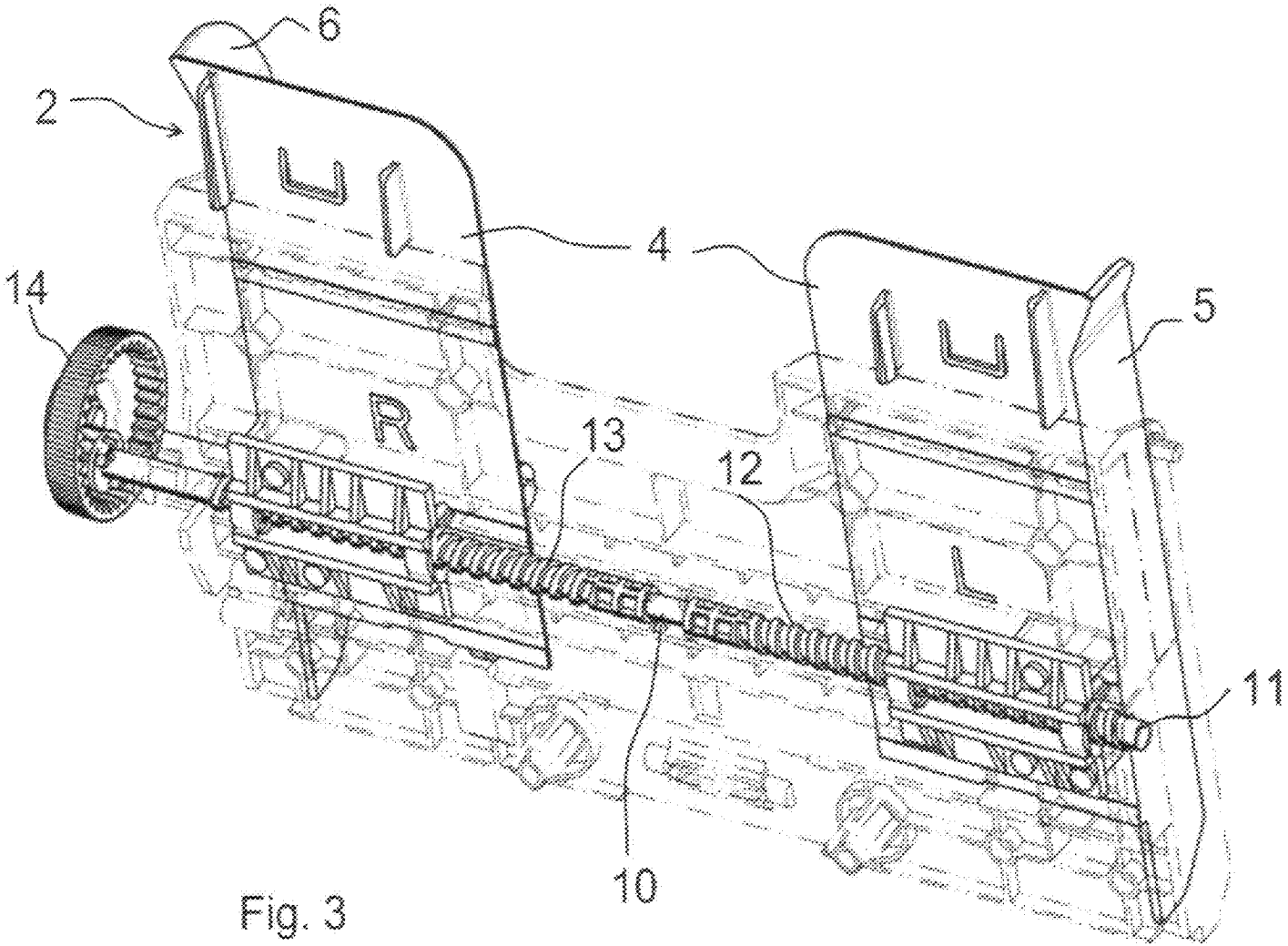

As is clearly shown in FIG. 3, the side guide adjustment mechanism 10 includes a lead screw 11 having a first portion 12 with right hand threads operatively connected with the first item side guide 5 and a second portion 13 with left hand threads operatively connected with the second item side guide 6. Please note that the invention is not limited to the specific direction of the left and right hand threads as shown in FIG. 3, but that the left and right hand threads can also be the other way around.

Figure 2:
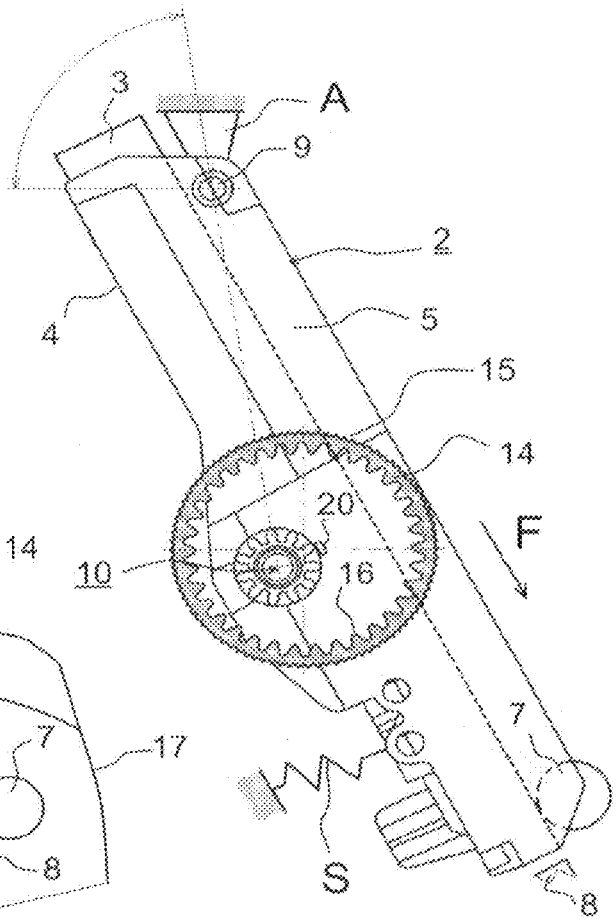
FIG. 2 is a schematic side view, partly in cross-section, in which the holder is in the feeding position.

In the example shown in FIGS. 1-3 an operator movable wheel member 14 forms a drive means which can be connected to or can be engaged with the side guide adjustment mechanism 10. The operator movable wheel member 14 has an outer surface 15 for engagement by the operator such that the wheel member 14 is rotatable in a first direction and in a second direction opposite to the first direction. When rotated in the first direction the first and second item side guides 5, 6 will move toward each other and when rotated in the second direction the first and the second item side guides 5, 6 will move away from each other.

When the item platform 4 is placed in the feeding position shown in FIG. 1 by appropriate swiveling around the swivel axle 9, the wheel member 14 is out of engagement with the adjustment mechanism 10. The swivel axis 9 is suspended to a fixed or stationary part of the apparatus as indicated by reference A. This is realized in the example shown in FIGS. 1-3 in that the wheel member 14 has an inner surface 16 which can be brought into engagement with the adjustment mechanism 10 when the item platform 4 is in the loading position. The swiveling itself can be obtained in a manner known per se, and is therefore only shortly discussed with reference to FIG. 4.

Figure 4:
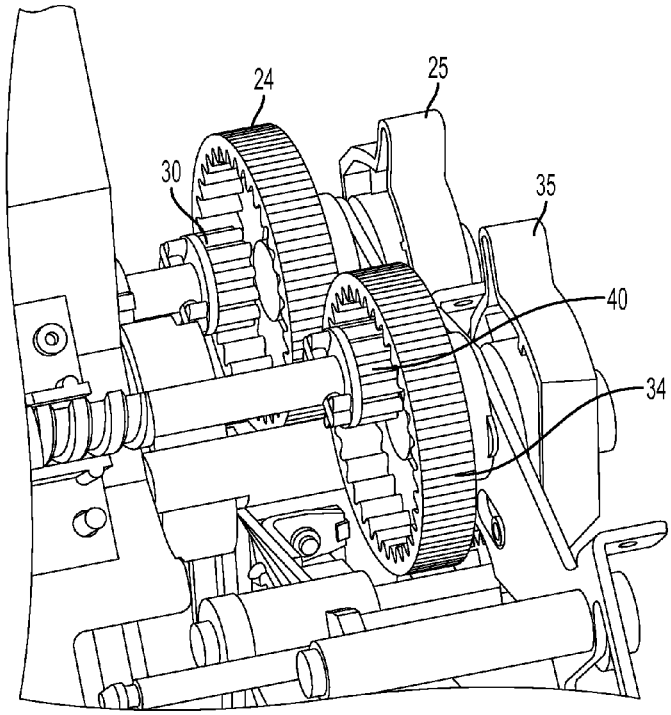
FIG. 4 is a perspective view of part of an embodiment of the inventive apparatus showing handles, each for swiveling the respective item platform from a feeding position into a loading position or vice versa.

FIG. 4 schematically shows a part of an embodiment of an inventive apparatus for feeding sheetlike items having two item platforms in perspective. In FIG. 4 two operator movable wheel members 24, 34 can be distinguished. The inner surface of each wheel member 24, 34 can be brought into and out of engagement with a respective adjustment mechanism 30, 40. A small handle 25, 35 is placed close to a respective adjustment wheel 24, 34. As can be seen in FIG. 4 the handle 25 is placed in the filling or loading position in which the item platform, the side guides and the lead screw are moved away from the respective feed roller. This position can be indicated as 'unlocked' on the apparatus. In this position the inner surface of the wheel member 24 is in engagement with the adjustment mechanism 30. The handle 35 shown in FIG. 4 is placed in the feeding position in which the item platform, the side guides and the lead screw are moved towards the respective feed roller. In the present embodiment this is achieved by a spring S (see FIGS. 1 and 2) that biases the item platform with the side guides and lead screw towards the feed roller 7. This position can be indicated as 'locked' on the apparatus. In this position the inner surface of the wheel member 34 is out of engagement with the adjustment mechanism 40. The movement (swiveling) of the item platform, the side guides and the lead screw away from and towards the respective feed roller (indicated by the arrow B in FIG. 1) is generated by a cooperation of the handle 25, 35 with a respective (non-shown) curve mechanism and is performed by a manual action of the operator. Since the adjustment mechanism is mounted to the item platform movement of the item platform causes the adjustment mechanism to move together with the item platform as is indicated by arrow C in FIG. 1. In the example shown in FIGS. 1 and 2 the spring is depicted as a push spring pushing the item platform towards the feed roller, but it will be appreciated that also a pulling spring pulling the platform towards the feed roller or any other known principle using a spring force can be used.

As is clearly shown in FIG. 2, the inner surface 16 of the wheel member 14 is out of engagement with the adjustment mechanism 10 when the item platform 4 is swiveled in the loading position.

Consequently, the wheel member 14 is only in engagement with the side guide adjustment mechanism 10 when the item platform 4 is in the loading position and only in this position the item side guides 5, 6 can be moved towards or away from one another. In the feeding position shown in FIG. 2 the wheel member 14 is out of engagement with the side guide adjustment mechanism 10, thus preventing that the item side guides 5, 6 can be moved towards or away from one another by operating on the wheel member.

In FIG. 1 only a part of the apparatus 1 is indicated in outlines. The apparatus 1 has an outer housing 17 which comprises housing side walls 19 adjacent to the holder 2. The operator movable wheel member 14 is arranged in a slot 18 in one of the housing side walls 19, which slot 18 is dimensioned such as to tightly receive the wheel member 14, thereby preventing dust, particles etc. to enter into the inside of the housing.

In FIGS. 1 and 2 a lock 20 is shown which is arranged in a fixed position relative to the housing. When the item platform 4 is in the feeding position shown in FIG. 2 the lock 20 engages the lead screw 11 such that the lead screw 11 cannot be rotated. When the item platform 4 is swiveled into the loading position shown in FIG. 1 the lock 20 is automatically placed out of engagement with the lead screw 11 thus enabling that rotation of the wheel member 14 is transferred to the lead screw 11 to move the item side guides 5, 6 towards or away from one another. Preferably the lock 20 is spring biased so that the lock 20 can also function properly regardless of the thickness of the stack of sheets on the item platform 4. The invention is not limited to this specific type of lock which can be automatically unlocked when the drive means is brought into engagement with the side guide adjustment mechanism, but also other types of locks can be used in the inventive apparatus. For example, such an alternative lock can be formed by a self-locking side guide adjustment mechanism, as is e.g. the case when using a lead screw with a small pitch.

Although the example shown in FIGS. 1-3 depicts a top feeder the invention is also applicable to a bottom feeder. In the case of application in a bottom feeder provisions can be present to ensure that the underside of the stack of sheetlike items on the item platform does not make contact with the feeding means (e.g. roller(s) or belt(s)) below the item platform when in loading position. In this way side guide adjustment can easily take place.

The invention claimed is:

1. An apparatus for feeding sheetlike items from a stack of sheetlike items, comprising:

an item feed means for separating and feeding a single item from the stack of sheetlike items;

a holder for receiving the stack of sheetlike items, said holder comprising an item platform for supporting the stack of sheetlike items, and a first and a second item side guide for guiding sheetlike items of the stack in a feeding direction, said item platform being movable towards the item feed means into a feeding position in which separating and feeding of a single item from the stack of sheetlike items by the item feed means is enabled and away from said item feed means into a loading position in which the holder is able to receive a stack of sheetlike items, at least one of said item side guides being movable relative to the other one;

a side guide adjustment mechanism connected to said at least one item side guide such that when said side guide adjustment mechanism is moved in a first direction said at least one item side guide will move toward the other item side guide and when said side guide adjustment mechanism is moved in a second direction said at least one item side guide will move away from the other item side guide;

a drive means connected to said side guide adjustment mechanism operable to cause said side guide adjustment mechanism to move in said first and said second direction; wherein said drive means is out of engagement with said side guide adjustment mechanism when said item platform is in the feeding position.

2. An apparatus as claimed in claim 1, wherein said drive means only is in engagement with said side guide adjustment mechanism when said item platform is in the loading position.

3. An apparatus as claimed in claim 1, wherein the first and the second item side guide are movable, and the side guide adjustment mechanism is connected to said first and said second side guides such that when said side guide adjustment mechanism is moved in the first direction said first and second item side guides will move toward each other and when said side guide adjustment mechanism is moved in the second direction said first and said second item side guides will move away from each other.

4. An apparatus as claimed in claim 3, wherein the side guide adjustment mechanism includes a lead screw having a first portion with right hand threads operatively connected with said first item side guide and said second portion with left hand threads operatively connected with said second item side guide.

5. An apparatus as claimed in claim 1, wherein said drive means includes an operator movable wheel member that is rotatable in a first direction and in a second direction and when rotated in said first direction said first and second item side guides will move toward each other and when rotated in said second direction said first and said second item side guides will move away from each other, said wheel member having an outer surface for engagement by the operator and an inner surface which is in engagement with the side guide adjustment mechanism when said item platform is in the loading position, and which is out of engagement with the side guide adjustment mechanism when said item platform is in the feeding position.

6. An apparatus as claimed in claim 5, wherein the item platform for supporting the stack of sheetlike items is mounted on a swivel axle positioned upstream of the feeding means in the feeding direction for swiveling movement towards the item feed means into the feeding position and away from said item feed means into the loading position, said lead screw and said wheel member being positioned in feeding direction between the swivel axle and the item feed means.

7. An apparatus as claimed in claim 5, wherein the apparatus comprises an outer housing, said outer housing comprising housing side walls adjacent to the holder, said operator movable wheel member being arranged in one of the housing side walls, said one housing side wall having a slot for tightly receiving the wheel member.

8. An apparatus as claimed in claim 1, wherein the apparatus comprises a lock for locking the at least one item side guide against relative adjustment when said item platform is in the feeding position.

9. An apparatus as claimed in claim 8, wherein the lock is formed by a self-locking side guide adjustment mechanism.

10. An apparatus as claimed in claim 8, wherein the lock is automatically unlocked when said drive means is in engagement with said side guide adjustment mechanism when said item platform is in the loading position.

11. An apparatus as claimed in claim 1, wherein the apparatus is a top feeder.

* * * * *